United States Patent [19]

Bäumges et al.

[11] 4,352,466

[45] Oct. 5, 1982

[54] DEVICE FOR MAKING A THREAD RESERVE

[75] Inventors: Hans Bäumges, Nettetal; Hans-Jürgen Preuhs, Willich, both of Fed. Rep. of Germany

[73] Assignee: W. Schlafhorst & Co., Monchen-Gladbach, Fed. Rep. of Germany

[21] Appl. No.: 167,006

[22] Filed: Jul. 9, 1980

[30] Foreign Application Priority Data

Jul. 10, 1979 [DE] Fed. Rep. of Germany ..... 2927742

[51] Int. Cl.[3] ..... B65H 54/02; B65H 67/04

[52] U.S. Cl. ..... 242/18 PW; 242/35.5 A

[58] Field of Search ..... 242/18 PW, 18 A, 18 DD, 242/35.5 R, 35.5 A, 35.6 R, 41

[56] References Cited

U.S. PATENT DOCUMENTS

| | | | |
|---|---|---|---|
| 3,237,876 | 3/1966 | Franzen | 242/18 PW |
| 3,940,077 | 2/1976 | Ohashi | 242/18 A X |
| 3,948,452 | 4/1976 | Burysek et al. | 242/18 PW X |
| 3,960,336 | 6/1976 | Tschentscher | 242/18 PW |
| 4,015,786 | 4/1977 | Slavik et al. | 242/18 DD X |
| 4,047,674 | 9/1977 | Kamp | 242/18 DD |
| 4,138,071 | 2/1979 | Schewe | 242/18 PW X |

FOREIGN PATENT DOCUMENTS

| | | | |
|---|---|---|---|
| 2312609 | 10/1974 | Fed. Rep. of Germany | 242/18 PW |
| 2701985 | 7/1978 | Fed. Rep. of Germany | 242/18 PW |

*Primary Examiner*—Stanley N. Gilreath

*Attorney, Agent, or Firm*—Herbert L. Lerner; Laurence A. Greenberg

[57] ABSTRACT

Device for making a thread reserve on coil tubes for textile spools, having a coil frame for exchangeably holding the coil tubes while being rotated at an operating speed in a given direction, a take-up coil, and a winding cylinder, comprising friction wheel means driveable by the winding cylinder against the surface of a coil tube for rotating the coil tube for a short time at initial winding of the take-up coil at a speed lower than the operating speed, and means for driving the winding cylinder at a speed lower than the operating speed in a direction opposite the given direction while the thread reserve is being made.

4 Claims, 5 Drawing Figures

DEVICE FOR MAKING A THREAD RESERVE

The invention relates to a device for making a thread reserve on a coil or spool tube for textile coils which are interchangeably held by a spool frame and can be driven by a winding cylinder, at the beginning of the winding of a take-up coil, including a rotation device with a friction wheel drive that can be placed against the surface of the coil tube, with a speed of rotation which is lower than the operating speed of rotation.

The thread reserve which should be provided at the beginning of the winding operation of a take-up spool in addition to the winding proper, should have a minimum length and a minimum number of turns and should be wound so that it is preserved and not dissolved during the winding process, during the transport of the take-up spool and in the later handling of the take-up spool. However, the thread reserve must not be too long, must be detachable without trouble and able to be run off without fault.

Up to now, the coil tube used to be driven directly by the winding cylinder when forming the thread reserve. Since the winding cylinder rotates at the operating speed, the coil tube can be driven only with considerable inconsistent slip by the winding cylinder when the thread reserve is made. Thus, a different number of thread reserve turns is obtained from case to case. In addition, the minimum number of turns must be chosen larger than necessary for safety reasons.

It is an object of the invention to provide a device for making a thread reserve which overcomes disadvantages of the heretofore-known devices of this general type, and to do so in such a manner that the technical and economic cost becomes less, such as by eliminating expensive gear reduction motors, providing an easier power supply, a device which is less trouble prone and wherein the product to be made, namely the take-up coil with its thread reserve winding, becomes even better.

With the foregoing and other objects in view there is provided, in accordance with the invention, a device for making a thread reserve on coil tubes for textile spools, having a coil frame for exchangeably holding the coil tubes while being rotated at an operating speed in a given direction, a take-up coil, and a winding cylinder, comprising friction wheel means driveable by the winding cylinder against the surface of a coil tube for rotating the coil tube for a short time at initial winding of the take-up coil at a speed lower than the operating speed, and means for driving the winding cylinder at a speed lower than the operating speed in a direction opposite the given direction while the thread reserve is being made.

In accordance with another feature of the invention, the driving means is in the form of a controlled reversing drive.

In accordance with a further feature of the invention, there is provided a coil changing device comprising a tube feeder supporting the friction wheel means, a controlled thread guide supported by the tube feeder for laying the thread reserve, and a friction wheel drive for the coil tubes being disposed on the thread guide and driveable by the winding cylinder.

In accordance with a concomitant feature of the invention, the thread guide is provided with a rotatable cylinder having a worm-like screw thread.

The advantages obtained with the invention are in particular that, independently of the winding operation proper, a thread reserve of exactly reproducible length, number of turns and strength can be made.

Other features which are considered as characteristic for the invention are set forth in the appended claims.

Although the invention is illustrated and described herein as embodied in a device for making a thread reserve, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
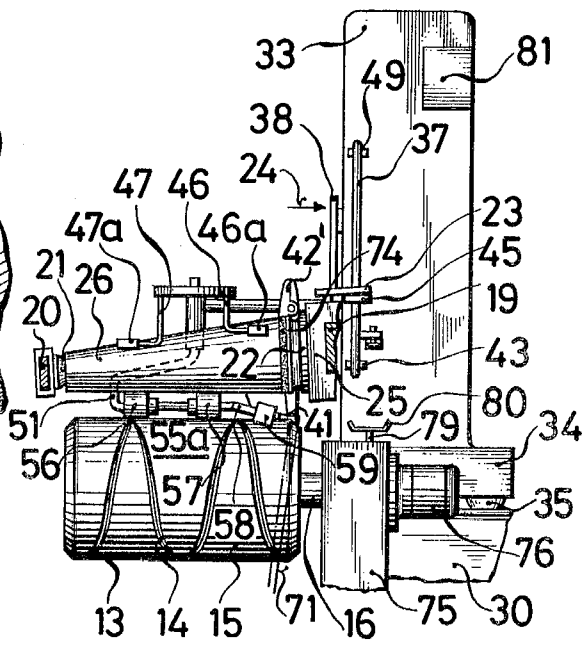
FIG. 1 is a diagrammatic fragmentary front elevational view of the invention as employed in a winding device.
Figure 2:
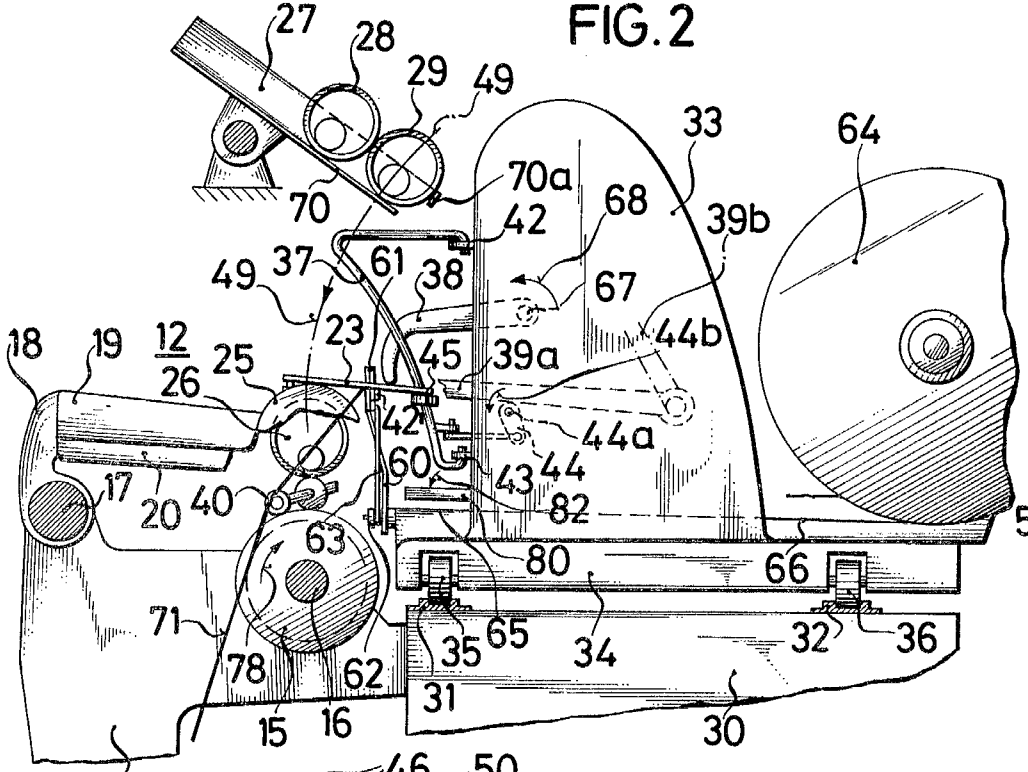
FIG. 2 is a fragmentary side elevational view of the device of FIG. 1.

Referring now to the figures of the drawing and first particularly to FIGS. 1 and 2 thereof, it is seen that the machine frame 11 of the winding device 12 of a winding machine which has a multiplicity of identical winding devices, has a winding cylinder 15 provided with reversing thread grooves 13, 14. The winding cylinder 15 is mounted on a shaft 16. A coil frame 18 which has side arms 19, 20 is suspended at a swivel joint 17. The side arm 20 has a rotatable tube receiver 21 and the side arm 19 has a rotatable tube receiver 22, which, in addition, can also be shifted in the axial direction by means of a rocking lever 23. If the rocking lever 23 is moved in the direction of the arrow 24 in FIG. 1, the tube receiver 22 is moved in the same direction against the force of a spring, which is covered up by the tube receiver housing 25, and is therefore not shown. As soon as the force on the rocking lever 23 ceases, the spring shifts the tube receiver 22 back into the starting position, in the process of which a coil tube 26 can be picked up and clamped as is shown particularly in FIG. 1.

The coil tube 26 can be driven by the winding cylinder 15 when the coil frame 18 is lowered until the coil tube 26 touches the winding cylinder 15. The drive is by friction. Above the coil frame and the winding cylinder, there is disposed a tube magazine 27 which contains two empty coil tubes 28 and 29, as is seen in FIG. 2.

Tracks 31, 32 are disposed on an understructure 30 behind the machine frame 11. A traveling coil changing device 33 can be moved on the tracks 31, 32 along the entire length of the winding machine. The coil changing device 33 comprises a carriage 34 with rollers 35, 36, a frame opener 37, a frame hold-down device 38, a tube feeder 39*a*, a hinged thread guide 40*a* and a hinged pair of thread clamping scissors 42'.

The frame opener 37 is pivoted at the joints 42, 43 by means of a crank 44, which is mounted on a shaft 44*a*, and has a stop 45, that makes contact with the rocking lever 23 from below when the coil frame 18 is opened. This prevents the coil frame 18 from being lowered during the coil changing operation.

The frame hold-down device 38 serves for holding down the coil frame 18 by virtue of being placed on the rocking lever 23 from above. The rocking lever 23 is first pressed against the stop 45 and, after the frame opener 37 is swung back, is quickly lowered further, so that the coil tube comes into contact with the winding cylinder and the winding can be initiated at an accelerated pace.

Figure 3:
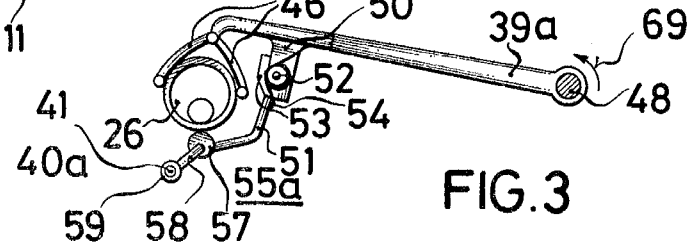
FIGS. 3, 3*a* and 4 are a diagrammatic elevational and two enlarged fragmentary perspective views which relate to details of the device according to the invention.
Figure 3A:
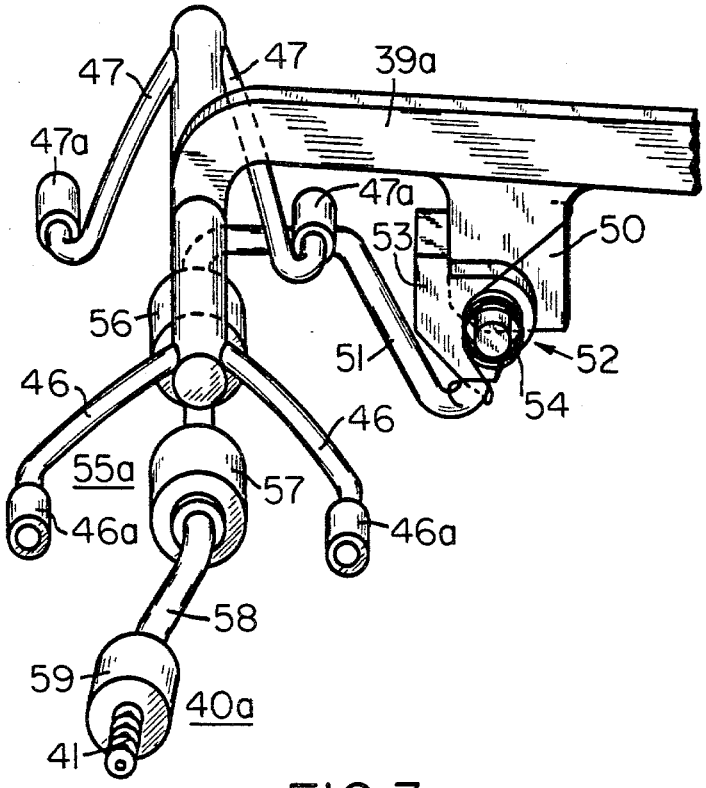

The tube feeder 39*a*, also seen in FIG. 3 and FIG. 3*a*, carries tube grippers 46, 47 at its end. The tube grippers are disposed in pairs and carry rollers 46*a* and 47*a*, respectively at the ends thereof. The tube grippers can be moved on a circular track 49 by rotation of the shaft 48. The tube feeder 39*a* has an outrigger arm 50, to which a roll holder 51 is fastened by means of a joint 52. In the rest position, a stop 53 fastened to the roll holder 51 is placed against the outrigger arm 50 under the action of a coil spring 54. The roll holder 51 carries a friction wheel drive 55*a* including the friction wheels 56 and 57, as well as the hereinafore-mentioned thread guide 40*a* including a friction wheel drive which is composed of a lever 58 and a friction wheel 59.

The friction wheel 59 carries a cylinder 41 which is provided with a worm-like screw thread. The lever 58 is connected by a strong coil spring 77 to the end of the roll holder 51. Guide rods 83, 84 seen in FIG. 4 serve for guiding the thread 71, and also for the purpose of forming a thread reserve. The thread clamping scissors 42' are fastened to a holder 60. Their movable scissor blade 61 can be opened and closed by a crank 62 by means of a rod 63.

A controlled reversing drive 75 which drives the shaft 16 is associated with the winding cylinder 15. The reversing drive itself is driven by a drive motor 76.

Figure 4:
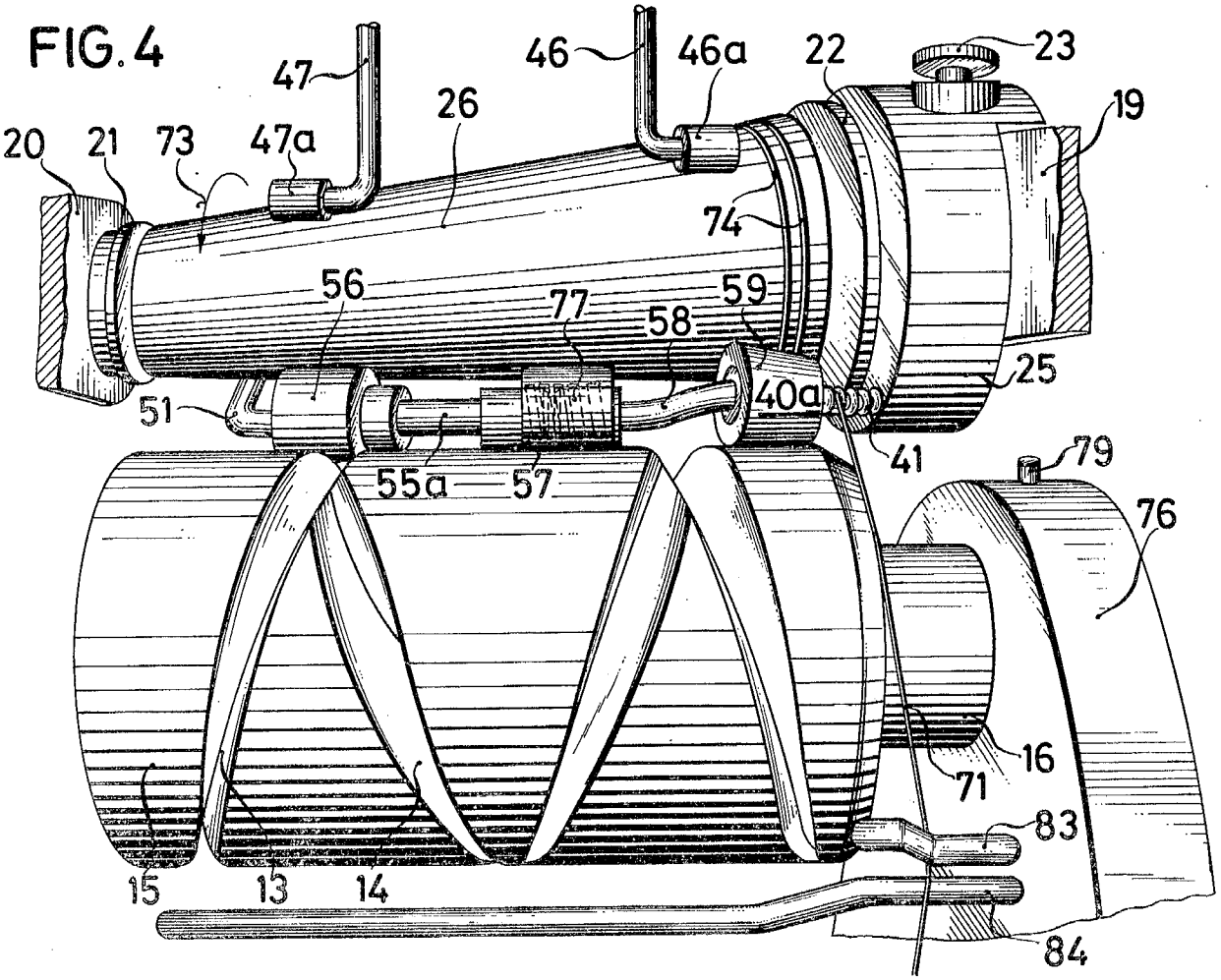

The friction wheel drives 55*a* and 58/59 can be driven by the winding cylinder 15 as soon as the roll holder 51 has swung both friction wheel drives between the winding cylinder 15 and the coil tube 26, as is shown in FIGS. 1, 2 and 4. During the phase when the thread reserve 74 is being made, the reversing drive 75 is shifted so that the shaft 16 is driven at reduced speed against its operating direction of rotation which is indicated by a curved arrow 78 in FIG. 2. For this purpose, the reversing drive 75 has a double throw switch 79 in the form of a roll switch, which can be operated by a switching bar 80 fastened to the coil changing device 33. At the coil changing device 33 there is further seen a programming mechanism designated overall with reference numeral 81, which controls all the switching steps and operations. The mechanism 81 will be discussed later on in accordance with a program.

As soon as the movable coil changing device 33 stops at the winding device 12 for the purpose of changing coils, the switching bar 80 is lowered onto the double-throw switch 79 in the direction of the arrow 82 in FIG. 2, whereby the winding cylinder 15 is shifted by means of the reversing drive 75 to reduced speed against the operating direction of rotation designated by the arrow 78.

In the rest position, the tube feeder 39*a* is in the position 39*b*. If a new coil tube is to be inserted into the coil frame 18, the crank 44 is first rotated against the direction of the arrow 44*b* in FIG. 2, so that the frame opener 37 is swung in the direction of the arrow 24 against the rocking lever 23 and the tube receiver 22 is thereby retracted and the coil frame 18 is thus opened. In the process, the finished take-up coil 64 rolls over a rolling surface 65 to a deposition surface 66 of the coil changing device 33. In this operation, a non-illustrated coil ejector can be made operative as an aid. In the mean time, the thread 71 is fed in from below and is still connected to the take-up coil 64, is initially held fast by the clamping scissors 42' and is then cut from the take-up coil 64 by the operation by the crank 62, while its end continues to be held.

In the meantime, the shaft 67 of the frame hold-down device 38 is rotated in the direction of the arrow 68, while the frame hold-down device 38 rests resiliently from the top against the rocking arm 23. In the process the rocking arm 23 comes into contact with the stop 45 of the frame opener 37. In this way, the coil frame 18 is locked in the position shown in FIG. 2. This is a position in which the coil tube 26 does not yet rest on the winding cylinder 15.

At this point in the operation of the device the shaft 48 of the tube feeder 39*a* is rotated in the direction of the arrow 69 shown in FIG. 3. In the process, the tube grippers 46, 47 are lowered from the right above onto the coil tube having the lowest position in the tube magazine 27, seize this coil tube while the roller holder 51 gives way automatically in a resilient manner, open the spring flap 70 of the tube magazine 27 and move with the coil tube further down on the circular track 49.

The spring flap 70 is reclosed automatically by spring force, while at the same time, the coil tubes 29 and 28 contained in the tube magazine slide downward against a stop 70*a*. The friction wheel drives 55*a* and 58/59 also give way resiliently to any obstacles during these processes by means of the joint 52. The friction wheels 56 and 57 support the coil tube from below while the tubes are being transported.

In the lower end position, finally, the tube feeder 39*a* is positioned so that the transported coil tube 26 is at the height of the tube receivers 21 and 22, as is shown in FIG. 1. Then, the shaft 44*a* is rotated a few degrees in the direction of the arrow 44*b*, whereby the frame opener 37 is swung back by spring force against the direction of the arrow 24. The rocking lever 23 still remains on the stop 45. By spring force, the tube receiver 22 then rests against the edge of the coil tube 26 and thereby clamps the thread 71 between the edge of the tube and the tube receiver. Then the frame opener 37 is swung back further against the direction of the arrow 24, so that the rocking lever 23 loses its contact with the stop 45. Under the action of the frame hold-down device 38, the rocking lever 23 and with it, the coil frame 18 is swung quickly in the direction toward the winding cylinder 15, so that the friction drives 55*a* and 58/59, come into contact with the winding cylinder 15 and are set in rotation by friction. In the meantime, the thread 71 travels into the worm threads of the cylinder 41 which guide it away from the edge of the coil tube in such a manner that the thread reserve 74 is generated on the coil tube 26. This phase of making a thread reserve is shown in particular in FIG. 4. The tube feeder remains in this position for a predetermined time interval until the thread reserve is finished. As can be seen by implication in FIG. 4, the tube grippers 46, 47 have moved slightly away from the coil tube 26. The coil tube 26 is rotated by the friction wheels 56, 57 in the direction of the arrow 73, whereby the thread 71 is wound up to form the hereinafore-mentioned thread reserve 74.

At the end of the predetermined time interval, the shaft 48 is rotated so far against the direction of the arrow 69 shown in FIG. 3, that the tube feeder 39*a* together with the friction wheel drives has occupied its starting position 39*b*. In this process the tube grippers 46, 47 swing on the circular track 49 through the region of the tube magazine 27 and the coil tubes stored in the magazine temporarily give way upwards. The resiliently supported roll holder 51 makes it possible to readily pull the friction wheel drives from their operating position. Last, the switching bar 80 is lifted, whereby the reversing drive is shifted to normal operation, while the coil tube 26 simultaneoulsy rests against the winding cylinder 15. The normal winding process can start over again, while the thread 71 has been eased into one of the reversing thread grooves of the winding cylinder 15.

The correct sequence and time of the operations described above is caused and maintained by the programming mechanism 81, which is a motor-driven mechanical control mechanism with cams, or it is done in another known manner.

There are claimed:

1. Device for making a thread reserve on a coil tube in a thread winding machine having a coil frame for exchangeably holding a coil tube and a winding cylinder for rotating the coil tube at an operating speed in a given direction to form a take-up coil, said device comprising friction wheel means driveable by the winding cylinder against the surface of the coil tube for rotating the coil tube for a short time at initial winding of the take-up coil at a speed lower than the operating speed, and means for driving the winding cylinder at a speed lower than the operating speed in a direction opposite the given direction while the thread reserve is being made.

2. Device according to claim 1, wherein said driving means is in the form of a controlled reversing drive.

3. Device according to claim 1 or 2, including a coil changing device comprising a tube feeder supporting said friction wheel means, a controlled thread guide supported by said tube feeder for laying the thread reserve, and a friction wheel drive for the thread guide being disposed on said thread guide and driveable by the winding cylinder.

4. Device according to claim 3, wherein said thread guide includes a rotatable cylinder having a worm-like screw thread.

* * * * *